US008881479B2

(12) United States Patent
McClure

(10) Patent No.: US 8,881,479 B2
(45) Date of Patent: Nov. 11, 2014

(54) WALL SYSTEM WITH VAPOR BARRIER SECUREMENT

(71) Applicant: BlueScope Buildings North America, Inc., Kansas City, MO (US)

(72) Inventor: Richard R. McClure, Basehor, KS (US)

(73) Assignee: BlueScope Buildings North America, Inc., Kansas City, MO (US)

( * ) Notice: Subject to any disclaimer, the term of this patent is extended or adjusted under 35 U.S.C. 154(b) by 0 days.

(21) Appl. No.: 13/953,219

(22) Filed: Jul. 29, 2013

(65) Prior Publication Data

US 2014/0041330 A1 Feb. 13, 2014

Related U.S. Application Data

(60) Provisional application No. 61/681,355, filed on Aug. 9, 2012.

(51) Int. Cl.

| | |
|---|---|
| ***E04B 1/74*** | (2006.01) |
| ***E04B 1/24*** | (2006.01) |
| ***E04B 1/66*** | (2006.01) |
| *E04H 5/10* | (2006.01) |

(52) U.S. Cl.

CPC ... *E04B 1/66* (2013.01); *E04B 1/24* (2013.01); *E04H 5/10* (2013.01); *E04B 2001/2481* (2013.01); *E04B 2001/2487* (2013.01)

USPC ..... 52/404.1; 52/408; 52/410; 52/483.1; 52/742.12; 52/745.09

(58) Field of Classification Search

USPC ..... 52/408, 404.1, 407.3, 410, 412, 746.1, 52/742.12, 745.09, 479, 481.1, 483.1

See application file for complete search history.

(56) References Cited

U.S. PATENT DOCUMENTS

| | | | | | |
|---|---|---|---|---|---|
| 2,968,070 | A * | 1/1961 | Wolstead | 52/364 |
| 3,474,583 | A * | 10/1969 | Manias | 52/302.7 |
| 4,058,949 | A * | 11/1977 | Bellem | 52/407.1 |
| 4,329,823 | A * | 5/1982 | Simpson | 52/407.4 |
| 4,346,543 | A * | 8/1982 | Wilson et al. | 52/404.2 |
| 4,361,993 | A * | 12/1982 | Simpson | 52/222 |
| 4,571,909 | A * | 2/1986 | Berghuis et al. | 52/309.8 |
| 4,642,961 | A * | 2/1987 | Cruise | 52/408 |
| 4,651,489 | A * | 3/1987 | Hodges et al. | 52/409 |
| 5,561,959 | A * | 10/1996 | Alderman et al. | 52/407.3 |
| 5,724,780 | A * | 3/1998 | Bolich | 52/407.4 |
| 5,765,330 | A * | 6/1998 | Richard | 52/309.13 |
| 6,694,693 | B2 * | 2/2004 | Alderman | 52/478 |
| 8,181,410 | B2 * | 5/2012 | Stensrud | 52/407.3 |
| 8,316,605 | B2 * | 11/2012 | Oberg | 52/404.1 |
| 8,615,946 | B2 * | 12/2013 | Oberg | 52/404.1 |
| 8,621,805 | B2 * | 1/2014 | Mcclure | 52/404.1 |
| 8,739,486 | B2 * | 6/2014 | Bodsford et al. | 52/506.05 |
| 2006/0026925 | A1 * | 2/2006 | Layfield | 52/782.1 |
| 2010/0071292 | A1 * | 3/2010 | Futterman | 52/412 |

* cited by examiner

*Primary Examiner* — Brent W Herring

(74) *Attorney, Agent, or Firm* — Lathrop & Gage LLP

(57) ABSTRACT

A system for assembling a pre-engineered building with a monolithic vapor retarder to control the formation of condensation on the walls. The system allows for numerous different combinations of insulation thickness, different kinds of walls, inside vapor retarders in different rigid panels, different facings or membranes. The system further provides for finished inside surfaces with high thermal quality.

23 Claims, 6 Drawing Sheets

WALL SYSTEM WITH VAPOR BARRIER SECUREMENT

CROSS-REFERENCE TO RELATED APPLICATIONS

This application claims the benefit of priority to U.S. Provisional Application No. 61/681,355 filed on Aug. 9, 2012.

BACKGROUND OF THE INVENTION

1. Field of the Invention

The invention relates generally to the field of metal buildings. More specifically, the invention relates to the field of insulating a building and maintaining a vapor barrier in a wall of the building.

2. Description of the Related Art

Walls are typically supported horizontally by girts attached to columns constituting bays within the building structure. Typically the girts attach into the sides of the columns with the column located near the wall/girt attachment line. This method causes the typical wall insulation and vapor retarder to terminate into the side of the column. With various webs, flanges and stiffeners needed at the column it makes it very difficult to fully insulate and utilize a continuous vapor retarder. Also, by locating the column near the wall line the insulation is usually compressed significantly minimizing the thermal performance of the wall system.

SUMMARY

A typical pre-engineered building wall consists of an outer exposed surface (wall panel), then insulation (blanket or board), and then a vapor retarder (on the interior, conditioned, side of the wall) which can consist of insulation facing, flexible membrane, metal liner (or panels) or other hard interior wall substrates with a good perm rating to minimize water vapor from migrating through it. The problem with the vapor retarder is where it joins up at locations where the building structure causes a break in the continuation of the barrier. This joint must be as tight as the vapor retarder material to maintain the continuation of the barrier. The disclosed technology provides a method to easily seal the joints of the vapor retarder at the structural column lines.

The disclosed technology installs the girts outside of the column line and eliminates this issue of compressing the insulation. Also, a trim piece is installed on the outside flange of the column to provide a surface to seal the vapor retarder from one side of the column to the other side. This trim extends the full height of the column to make contact with the roof vapor retarder therefore providing an integral roof vapor retarder.

It is critically important to maintain a continuous vapor retarder in the wall construction of a pre-engineered building and to have it tie to the roof vapor retarder so a continuous, monolithic vapor retarder occurs between the roof and wall. Without this monolithic, continuous vapor retarder, anywhere there is a void condensation or moisture can occur due to the relative humidity of the interior air reaching a surface that is at the dew point temperature. By maintaining a barrier, that is insulated to keep its temperature higher than the dew point temperature, condensation and moisture will avoided.

The typical wall and structural construction of a pre-engineered metal building creates numerous challenges that make it difficult to maintain a continuous vapor retarder throughout the wall and then tie it to the vapor retarder in the roof plane. The disclosed system, method and kit eliminates one of the major obstacles at each structural column line. The disclosed technology also provides for an area where economical blanket insulation can be installed in significant thickness with numerous exterior and interior wall configurations to make it very versatile for all kinds of wall systems. The purpose is to provide the high "R-value" wall system with a very good vapor retarder solution, and to provide this in a very easy to install method for the installer of the wall.

BRIEF DESCRIPTION OF THE SEVERAL VIEWS OF THE DRAWINGS

Illustrative embodiments of the present invention are described in detail below with reference to the attached drawing figures, which are incorporated by reference herein and wherein.

DETAILED DESCRIPTION

Before describing the instant invention in detail, several terms used in the context of the disclosed technology will be defined. In addition to these terms, others may be defined elsewhere in the specification, as necessary. Unless otherwise expressly defined herein, terms of art used in this specification will have their art-recognized meanings.

Girt: a horizontal structural member in a framed wall that provides lateral support to the wall panel, primarily, to resist winds loads.

Wall line: the outermost perimeter of the wall of a building.

Perm rating: a measure of the diffusion of water through a material.

Vapor retarder: a vapor retarder is defined by ASTM Standard C 755 as a material or system that adequately retards the transmission of water vapor under specified conditions.

Embodiments of the disclosed technology provide a system, a kit and a method for establishing an insulated wall for a building.

Figure 1:
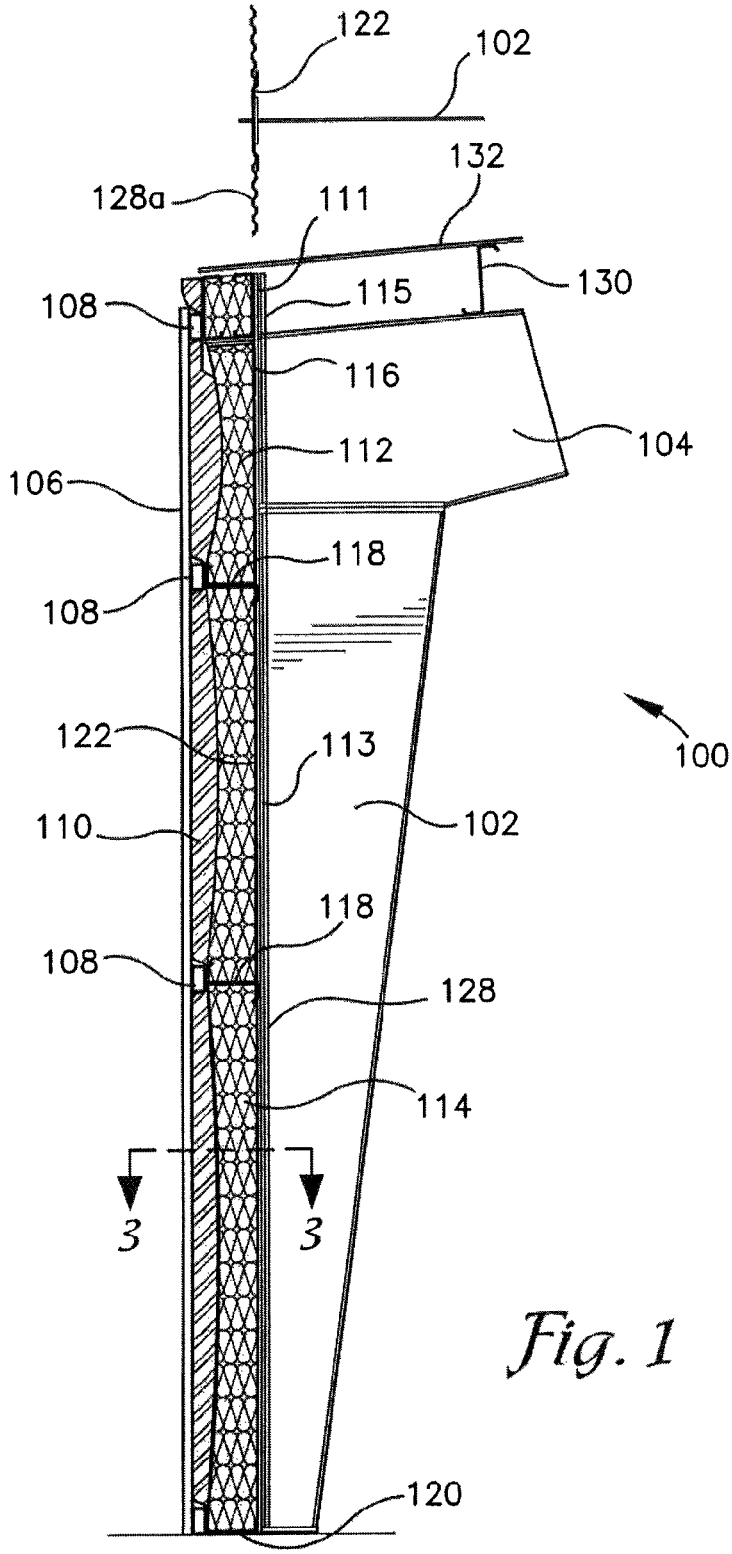
FIG. 1 is a side view of the system 100 in assembled form.
Figure 2:
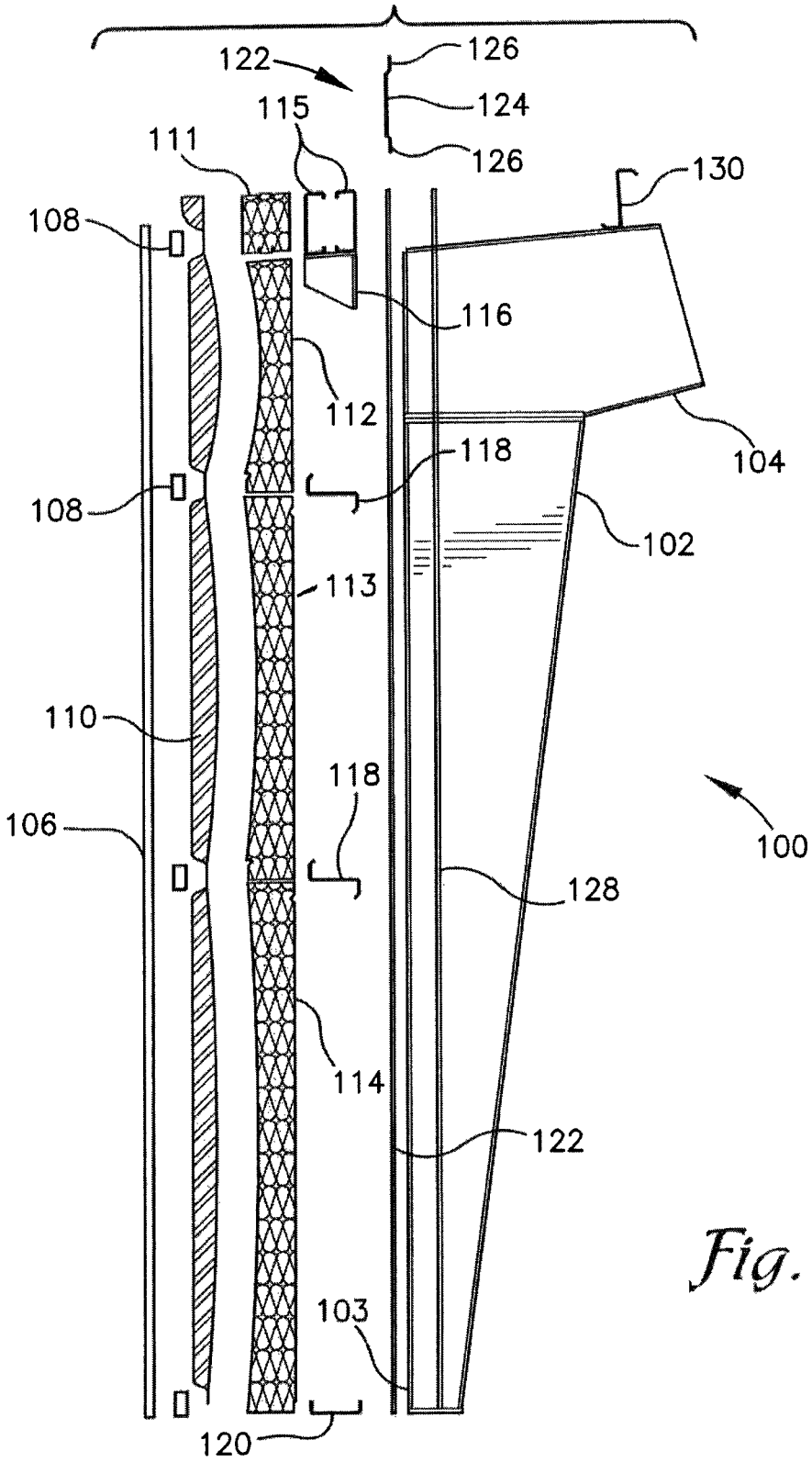
FIG. 2 is an exploded view enabling many of the features to be seen as they exist before assembly.
Figure 3:
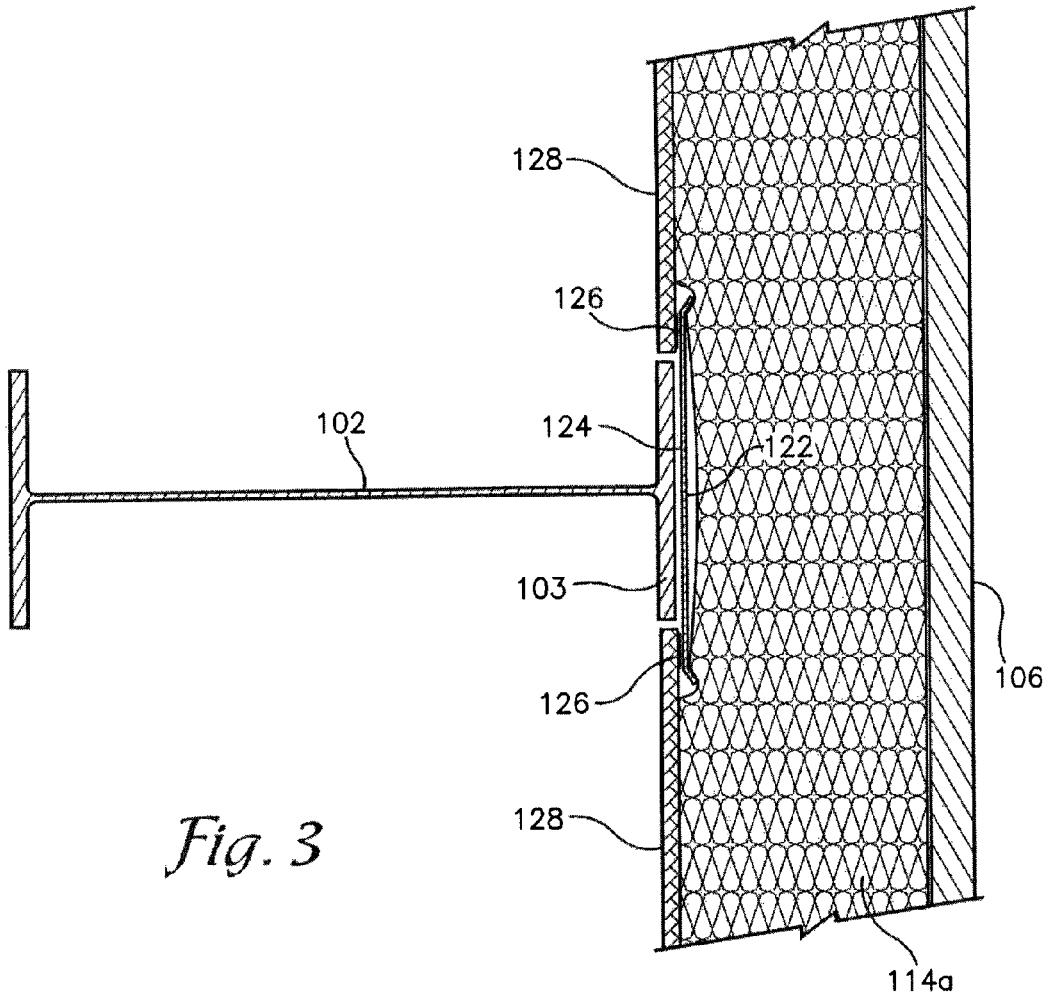
FIG. 3 shows a horizontal section taken at a 3-3 in FIG. 1.
Figure 4:
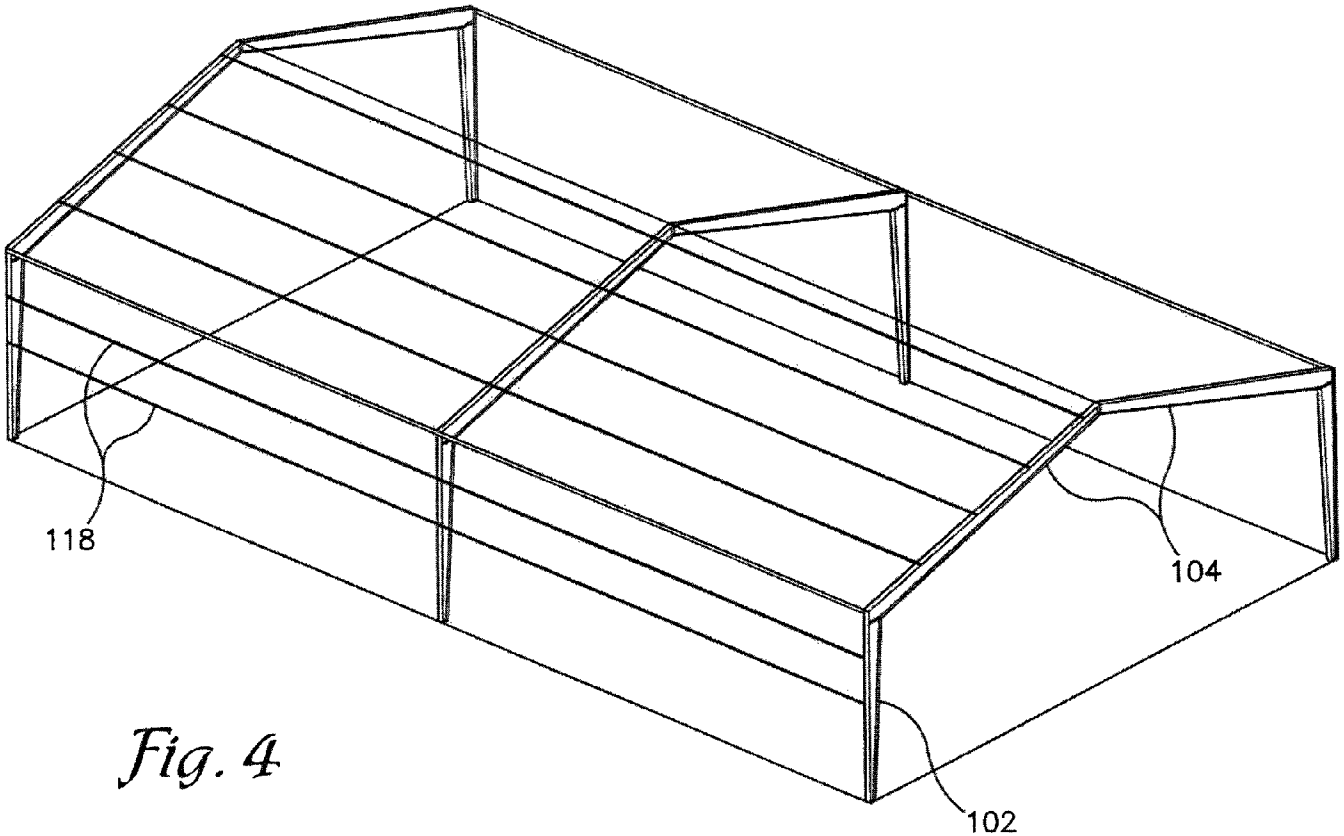
FIG. 4 is a perspective view showing the environment in which the wall system is used.
Figure 5:
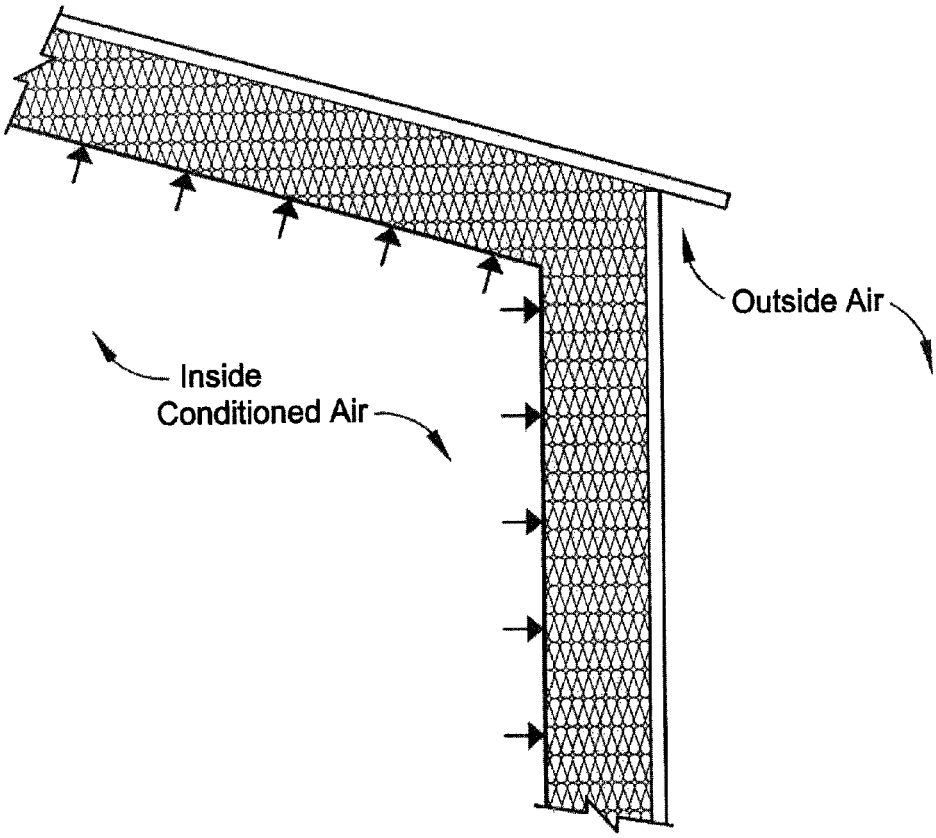
FIG. 5 is sectional view of a wall and roof of a pre-engineered building with insulation installed revealing outside and inside conditioned, i.e., heated or cooled, air.
Figure 6:
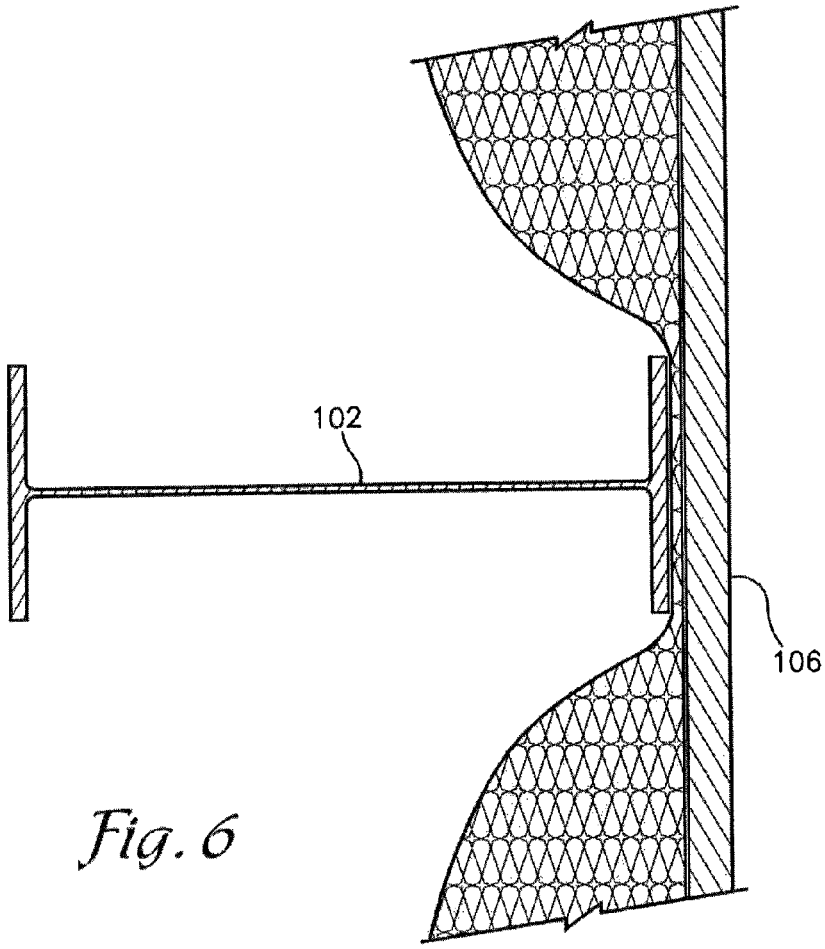
FIG. 6 is a sectional view of a column showing compressed insulation proximate the column flange.

Embodiments of the disclosed invention are shown in FIGS. 1-4. FIG. 5 reveals a sectional view of a pre-engineered building wall and roof detailing the installation of insulation. FIG. 6 is a column sectional view, consistent with that shown in FIG. 3, except that this figure details how the insulation is typically compressed between the column flange and the exterior wall panel 106 thereby reducing the capacity of the insulation to retard heat transfer. FIG. 1 shows an embodiment for a system 100 in assembled form. FIG. 2 is an exploded view enabling many of the features to be seen as they exist before assembly. FIG. 3 shows a horizontal section taken at a 3-3 in FIG. 1, and discloses the roof/column interface of the system in more detail. FIG. 4 shows the environment in which the wall system is used.

Referring to FIGS. 1 and 2, it can be seen that the system is mounted on to a typical metal column 102 and beam 104 arrangement which exists at a location where the wall and roof meet. In the environment of a typical building, FIG. 4 shows where the column 102, beams 104, and girts 118 might appear. Referring back to FIGS. 1 and 2, it can be seen that a wall panel 106 is ultimately secured onto the outside of the building. In the embodiments disclosed, this panel 106 is metal, but could be constructed of other materials.

Also used to construct the system are a plurality of horizontally extending spacer blocks 108. The spacer blocks 108 are typically made from a foam board insulation product. Blocks 108 are fastened onto the girts 118 over a blanket sheet of insulation 110. Insulation blanket 110 might be constructed of a fiberglass insulation, but might be comprised of another sort of insulating material.

Also included in the system are top 111, upper 112, mid 113, and lower 114 batts of insulation. The batts, in the preferred embodiment, are made of faced or unfaced commercially available fiberglass insulation material. But other insulating materials could be used instead.

Top batt 111 is contained within a pair of opposed metal C-members 115. Below that, the upper batt 112 rests above one of the girts 118. Below that, the slightly larger mid batt 113 is located above another girt 118. Then below that, the lower batt 114 rests atop an upwardly facing receiving bracket 120.

Referring to FIGS. 2 and 3, a trim piece 122 is used to secure a vapor barrier 128 on the inside of the building and along with vapor barrier 128, is used to create a seal. In an embodiment, piece 122 is constructed of metal, but it could be made of other materials. Vapor barrier 128, is shown as having different embodiments. For example, in the disclosed FIGS. 1-3, the liner is seen as being a corrugated metal liner. But it could instead consist of insulation facing, a flexible membrane, metal panels or other hard interior wall substrates with a good perm rating to minimize water vapor from migrating through it. Regardless, in the disclosed embodiments, the liner is fasted to the trim piece to complete the seal.

The installation, in embodiments, occurs according to the following process.

First, the column 102 and beam 104 are erected according to known processes. Then, the trim piece 122 is held up in line with and thus overlapping the outer flange 103 of the column 102. With the trim piece 122 as thus, the external hardware, more specifically, the opposing C-members 115, bracket 116, girts 118, and receiving bracket 120 are all installed in the positions and orientations shown. Each piece of hardware is secured using fasteners. In the disclosed embodiment the hardware is pre-punched or drilled so that it can accept bolts. Of course, other fastener arrangements could be used. The fasteners pass through the trim piece 122 (which can also be pre-punched) and then through predrilled holes into either the outer flange 103 of column 102 (for the girts 118 and receiving bracket 120) or the outer flange of the beam 104 (for the upper bracket 116). Nuts can be used to complete the securing of the bolts. Thus, the trim piece 122 is secured between the external hardware and outer flange of the column. Outer margins 126 of the trim piece will extend wider than the flanges (e.g., flange 103 of column 102 as seen in FIG. 3; also the outer flange of the beam 104), there being useful for receiving the vapor liner 128. A flat center portion 124 of the trim piece 122 is in contact with the outer flange 103 of the column 102 after being sandwiched by the exterior hardware (e.g., girts 118 and receiving bracket 120) upon fastening. A small upper portion of the trim piece 122 extends into the space created by purlins (e.g., purlin 130) between the top of the beam 104 and an upper roof structure 132.

Now, with the outer hardware being fastened into place, vapor barrier sheets 128 are installed by adhering them to the exposed outer margins 126 (see FIG. 3) of the trim piece 122 using an adhesive, double sided tape, or fasteners.

Next the batts of insulation 111, 112, 113, and 114 are installed. Batt 111 is installed by pressing it between the opposing C-members 115. Alternatively, it could be installed before that after the first outward facing C-member is fastened onto the bracket 116. Then the outer C-member could be installed into the open C of the outwardly facing C-member, and the outer C-member then fastened into place thus containing the insulation batt 111.

The remaining three batts are installed from outside the building. More specifically, batt 112 is placed between the upper bracket 116, and the girt 118 right below it. Some batts include adhesive pin tabs about their periphery. This enables them to remain in place after being located in the space desired. Similarly, batt 113 is secured into place underneath the top girt and the girt immediately below it, and pinned. The lower batt 114 is pinned into place between the lower girt, and the receiving bracket 120.

It should be noted that FIG. 3 shows only a single homogenous form 114*a* of insulation. This figure, in embodiments, would include the same insulation features (e.g., a blanket and batt), but does not depict these features for simplicity sake. Alternatively, however, the trim piece 122 and vapor barrier features could be used with the single type insulation embodiments like the one shown in FIG. 3. Regardless, it should be understood that the trim piece/vapor barrier arrangement could work equally well with numerous insulation arrangements.

Now with the internals being secured in place, the blanket of insulation 110 is draped over the outside of the frame, normally by tacking it up at the top somewhere (e.g., near the C-members 115), so that it extends all the way down to the ground. The blanket insulation 110, which comes in rolls, can be premeasured and precut to size, or cut at the ground after it has been unfurled.

In the disclosed embodiment, the spacer blocks 108 are adhered to the inside surfaces of the exterior wall panel 106 in the appropriate orientations before the panel is installed. Then, the wall panel 106 is raised into position and mounted. This is done by installing fasteners (through pre-punched holes in the outside of the panel) through the blocks 108 (also pre-punched) and through predrilled holes existing in the outer hardware. For example, at the top of the assembly, bolts will be slid through the panel, through the holes through the respective spacer block, through the outside C-member 115, and nuts will be secured thereon. Below that, bolts will be slid through the wall panel, blocks, through predrilled holes in the outer flanges of the girts 118, and nuts will be secured thereon. Then, a last group of bolts will pass through holes in the panel and block, through the outer flange of the receiving bracket 120, and nuts secured thereon.

It should be noted that alternative assembly of the components could be made. For example, after the installation of the hardware components 115, 116, 118, and 120, but before the installation of the liner 128 and batt insulation components 112, 113, and 114, the blanket insulation 110 could be tacked and the wall panel 106 with blocks 108 could be installed thereover. Then, the batts 112, 113, and 114 could be installed from the inside of the building, and the vapor barrier liner 128 adhered to the trim flanges 126.

Many different arrangements of the various components depicted, as well as components not shown, are possible without departing from the spirit and scope of the present invention. Embodiments of the present invention have been described with the intent to be illustrative rather than restrictive. Alternative embodiments will become apparent to those skilled in the art that do not depart from its scope. A skilled artisan may develop alternative means of implementing the aforementioned improvements without departing from the scope of the present invention.

It will be understood that certain features and sub-combinations are of utility and may be employed without reference to other features and sub-combinations and are contemplated within the scope of the claims. Not all steps listed in the various figures need be carried out in the specific order described.

I claim:

1. A method to seal the joint lines of a vapor retarding barrier at the structural column lines of a pre-engineered building, the method comprising:

installing a plurality of structural building columns, each of the building columns including an outer flange and an upper element for securing the roof beam thereto;

selecting a horizontally extending girt of a preferred width for subsequent attachment to the outer flange of the columns;

offsetting a wall line of the building away from the structural columns by a distance roughly consistent with the span of the horizontally extending girt;

attaching a trim plate with a first and second side as well as an interior and an exterior face to the outer flange of each structural column, the trim plate first and second sides overhanging the column outer flange;

securing the horizontally extending girt over the trim plate and to the outer flange of the structural columns;

positioning a first blanket of insulation atop the girt;

positioning a second blanket of insulation adjacent the first blanket, the second blanket having at least one horizontally extending depression therein aligned with the at least one horizontally extending girt;

securing at least one horizontally extending spacer block to an exterior wall panel, wherein the spacer block is positioned for receipt into the at least one horizontally extending depression;

securing the exterior wall and spacer blocks to the girt; and securing an interior vapor barrier to both the first and second overhanging sides of the trim plate thereby eliminating any direct metal pathway between the interior and the exterior of the walls of the pre-engineered building.

2. The method of claim 1, wherein the width of the girt is preferably between 3 and 14 inches.

3. The method of claim 1, wherein a beam is secured to the uppermost extreme of the column, the beam providing structural support for elements of the roof.

4. The method of claim 3, wherein the trim plate is secured to the flange of the column extending from ground level to the top of the beam.

5. The method of claim 1, wherein the first and second blanket of insulation are unfaced.

6. The method of claim 1, wherein the horizontally extending spacer blocks are preferably fabricated from a foam board insulation product.

7. The method of claim 1, wherein the interior vapor barrier is at least one of 1) a corrugated metal liner; 2) a flexible membrane; or 3) a hard interior wall substrate with a good perm rating to minimize water vapor migration through the wall.

8. The method of claim 1, wherein the interior vapor barrier extends continuously beyond the column upper element to the roof of the building thereby maintaining a monolithic vapor barrier system within the building.

9. The method of claim 1, wherein the trim plate extends the full height of the column making contact with a roof vapor barrier thereby providing a continuous vapor barrier interface between the wall and the roof.

10. A kit for assembling a pre-engineered building with a monolithic vapor retarder to control the formation of condensation on the walls, the kit comprising:

a plurality of structural building columns, each of the building columns including an outer flange;

at least one horizontally extending girt of a pre-determined width for subsequent attachment to the outer flange of the columns, wherein the wall line of the building is offset away from the structural columns by a distance roughly consistent with the span of the selected girt;

a trim plate with a first and second side as well as an interior and an exterior face secured to the outer flange of each structural column, the trim plate first and second sides extending laterally beyond the column outer flange;

the at least one horizontally extending girt secured over the trim plate and to the outer flange of the structural columns;

a first blanket of insulation disposed atop the girt;

a second blanket of insulation positioned adjacent the first blanket, the second blanket having at least one horizontally extending depression therein, the depression aligned with the position of the at least one horizontally extending girt;

at least one horizontally extending spacer block secured to an exterior wall panel, wherein the spacer block is positioned for receipt into the at least one horizontally extending depression and the exterior wall and spacer blocks are secured to the girt; and an interior vapor barrier secured to both the first and second laterally extending sides of the trim plate thereby eliminating any direct metal pathway between the interior and the exterior of the walls of the pre-engineered building.

11. The kit of claim 10, wherein a beam is secured to the uppermost extreme of the column, the beam providing structural support for elements of the roof.

12. The kit of claim 11, wherein the trim plate is secured to the flange of the column extending from ground level to the top of the beam.

13. The kit of claim 10, wherein the first and second blanket of insulation are unfaced.

14. The kit of claim 10, wherein the horizontally extending spacer blocks are preferably fabricated from a foam board insulation product.

15. The kit of claim 10, wherein the wherein the interior vapor barrier is at least one of 1) a corrugated metal liner; 2) a flexible membrane, or 3) a hard interior wall substrate with a good perm rating to minimize water vapor migration through the wall.

16. The kit of claim 10, wherein the span of the girt is preferably between 3 and 14 inches.

17. The kit of claim 10, wherein the trim plate extends the full height of the column making contact with a roof vapor barrier thereby providing a monolithic vapor barrier interface between the roof and the wall.

18. A system for insulating and maintaining a continuous vapor barrier in the construction of a pre-engineered building, the system comprising:

a plurality of building columns that are inset from a wall line by a pre-determined distance, the building columns having a flange facing the exterior of the building;

a plurality of trim plates, each with first and second edges and an interior and exterior facing surface, each trim plate being secured to one each of the the column flanges with the first and second edges extending laterally beyond the flange and wherein the trim plate extends the full height of the column making contact with a roof vapor barrier thereby providing a monolithic vapor barrier interface between the roof and the wall;

a liner secured to the trim plate interior facing surface and extending between the plurality of building columns;

at least one girt secured to the plurality of columns, the girt including a horizontal portion upon which a first blanket of insulation is disposed, the first blanket of insulation extending laterally between building columns;

a second blanket of insulation positioned against the first blanket, the second blanket including at least one horizontally extending depression, the elevation of the depression being consistent with the elevation of the at least one girt;

an exterior wall panel with an interior and exterior facing surface; and at least one spacer block secured on a first side to the interior surface of the exterior wall panel, the at least one spacer block received within the depression in the second blanket of insulation, a second side of the spacer block secured to the at least one horizontally extending girt, the spacer block extending longitudinally along the entire length of the girt; wherein when the exterior wall is in position the spacer block prevents direct metal to metal pathway between the girt and the exterior wall.

19. The system of claim 18, wherein the liner is at least one of 1) a corrugated metal liner; 2) a flexible membrane, or 3) a hard interior wall substrate with a good perm rating to minimize water vapor migration through the wall.

20. The system of claim 18, wherein the building columns are preferably inset from a wall line in the range of from 3 to 14 inches.

21. The system of claim 18, wherein the at least one girt is preferably two or more girts.

22. The system of claim 18, wherein the at least one spacer block is preferably comprised of a foam board insulation product.

23. The system of claim 18, wherein the second blanket of insulation is preferably fiberglass insulation.

* * * * *